US006099411A

United States Patent [19]

Van Wagenen

[11] Patent Number: 6,099,411

[45] Date of Patent: Aug. 8, 2000

[54] MULTI-LAYER AND MULTI-CHAMBER PLAY STRUCTURE

[75] Inventor: Gary B. Van Wagenen, San Marino, Calif.

[73] Assignee: Western Mill Fabricators, Inc., Orange, Calif.

[21] Appl. No.: 09/399,693

[22] Filed: Sep. 21, 1999

[51] Int. Cl.[7] ..... A63G 31/00

[52] U.S. Cl. ..... 472/136; 472/62; 482/35; 52/282.2

[58] Field of Search ..... 472/136, 137, 472/62; 52/36.1, 36.5, 79.5, 282.2, 282.3, 283, 284, 293.3, 295, 236.6; 482/35, 36

[56] References Cited

U.S. PATENT DOCUMENTS

| | | | |
|---|---|---|---|
| 1,530,951 | 3/1925 | Krauss | 52/282.2 X |
| 4,186,533 | 2/1980 | Jensen | 52/184 |
| 5,226,864 | 7/1993 | Showers | 482/35 |
| 5,425,520 | 6/1995 | Masumoto | 52/282.2 X |
| 5,496,232 | 3/1996 | Morris et al. | 482/35 |
| 5,647,181 | 7/1997 | Hunts | 52/282.1 |
| 5,666,774 | 9/1997 | Commins | 52/298 |

*Primary Examiner*—Kien T. Nguyen
*Attorney, Agent, or Firm*—Lyon & Lyon LLP

[57] ABSTRACT

A multi-layer and multi-chamber play structure developed with solid, rigid quadrilateral panels arranged vertically and including wall angle brackets therebetween located in the included angles of the panels. Double wall thickness platforms are arranged on platform angle brackets which span across vertically adjacent panels lying in a common plane. Certain of the platforms are triangular in plan while others are rectilinear in plan. The panels come in various designs with holes extending through the panels and displaced form the edges thereof. The wall angle brackets may be rigid, elongate angle brackets and both the wall angle brackets and the platform angle brackets are affixed with fasteners to the panels and platforms. An adjustable anchor support is associated with the elongate angle brackets and includes a threaded bore receiving a threaded rod for purposes of adjustment.

16 Claims, 9 Drawing Sheets

MULTI-LAYER AND MULTI-CHAMBER PLAY STRUCTURE

BACKGROUND OF THE INVENTION

The field of the present invention is paneled play structures.

It is currently popular among fast food restaurants to include play structures for the entertainment of children. Such structures have typically employed large rotationally molded components and double wall panels able to be fit together by various means. Other such structures involve fabric and other flexible sheet materials defining wall sections and the like. Such devices have typically employed pipe frames to which the components are interlocked. Of these various structures, some require expensive molded components while others involve far more complicated assembly techniques.

SUMMARY OF THE INVENTION

The present invention is directed to a multi-layer and multi-chamber play structure which employs solid, rigid quadrilateral panels arranged substantially vertically and platforms of double wall thickness with the panels and platforms being associated together by angle brackets. The components are easy to fabricate with few being expensive and the assembly is relatively easy with low skill requirements.

In a first separate aspect of the present invention, the angle brackets extending between points of attachment of solid, rigid quadrilateral panels lying in a common plane include attachment to both panels and to an associated platform. For shorter structures, such construction is appropriate.

In a second separate aspect of the present invention, rigid, elongate angle brackets extend vertically across multiple panels. These elongate angle brackets are arranged within the included angle between adjacent solid quadrilateral panels. Platform angle brackets continue to support the rigid platforms at each story.

In a third separate aspect of the present invention, the foregoing aspects additionally may contemplate platforms which are triangular in plan with the hypotenuse displaced from the walls of the structure. Solid rectilinear platforms may also be incorporated into such structures.

In a fourth separate aspect of the present invention, structures including elongate angle brackets vertically arranged contemplate a plate at one end associated with anchor supports fixed in the foundation upon which the structure sits. The anchor supports may each include a threaded bore and a threaded rod employed for leveling adjustments.

In a fifth separate aspect of the present invention, the foregoing aspects are contemplated to be employed together for further structural enhancement of the play structures.

Accordingly, it is a principal object of the present invention to provide an improved play structure for children. Other and further objects and advantages will appear hereinafter.

DETAILED DESCRIPTION OF THE PREFERRED EMBODIMENT

Figure 1:
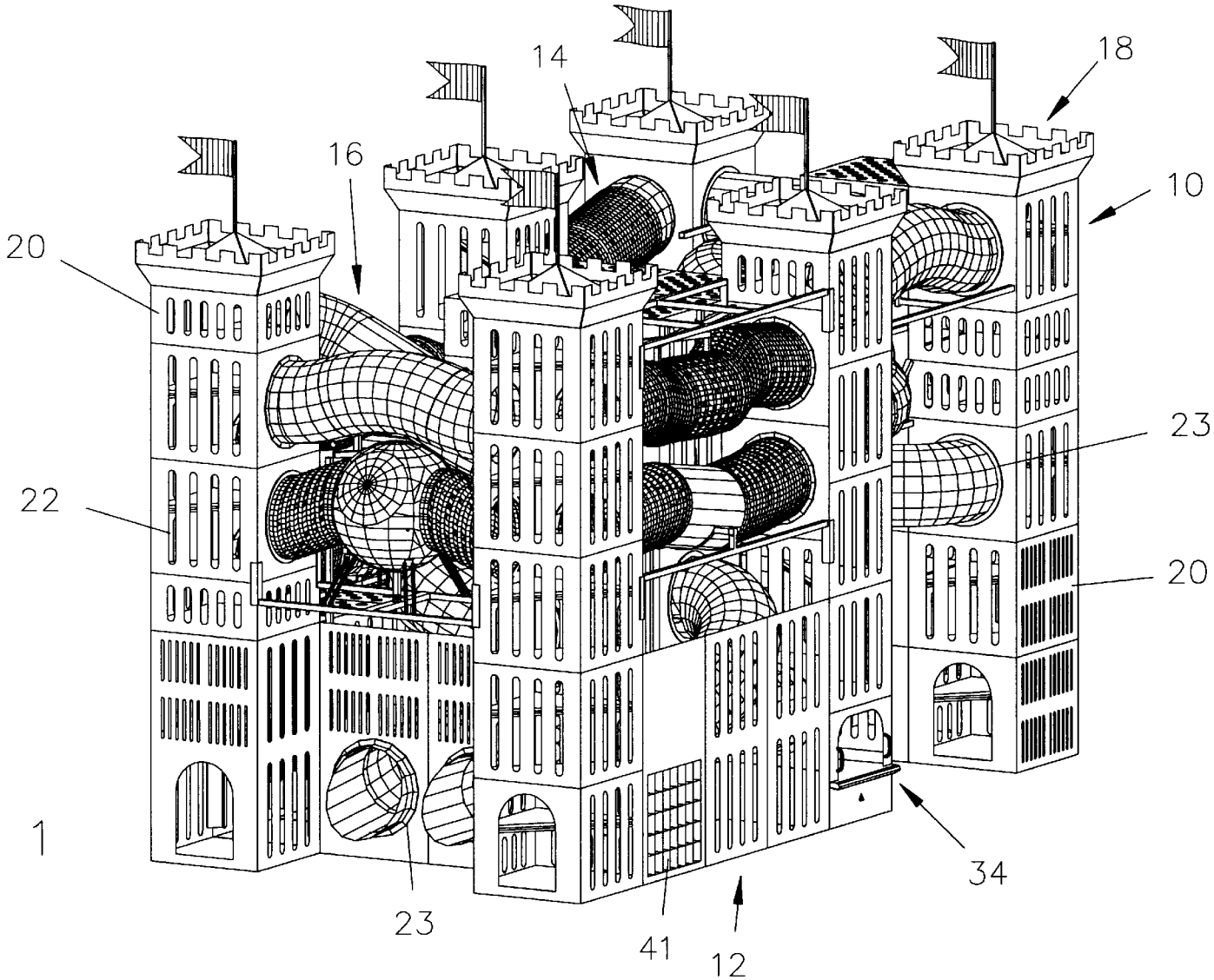
FIG. 1 is a perspective view of a complicated play structure constructed with the structure of the present invention.

Turning in detail to the Figures, FIG. 1 illustrates an extensive play structure which is multi-layered and multi-chambered. The structure includes towers, generally designated 10, with lower connecting wall structures, generally designated 12. Various panel treatments are illustrated on these towers 10 and connecting wall structures 12. Also interconnecting the towers are dynamic tubes, generally designated 14, as well as static tubes, generally designated 16. These tubes are conventional to such multi-layer and multi-chamber play structures. Tops, generally designated 18, act to enclose the structure and provide weather protection and/or ventilation.

A wide variety of solid, rigid quadrilateral panels 20 are illustrated in FIGS. 3 and 4. Looking to the panels 20 of FIG. 3, they may be defined by their appearance and construction. Most illustrated are shown to have holes 22 extending through the solid panels and displaced inwardly from the edges of these panels. These holes 22 provide ventilation and visibility. FIG. 3A illustrates a no-climb vertical slots panel. FIG. 3B illustrates a no-climb diagonal slots panel. FIG. 3C illustrates a diagonal ovals panel. FIG. 3D illustrates a wide slots panel. FIG. 3E illustrates a diamond holes panel. FIG. 3F illustrates a round holes panel. FIG. 3G illustrates a blank panel and FIG. 3H illustrates a door panel.

FIG. 4 illustrates square panels 20 rather than rectangular panels 20 as illustrated in FIG. 3. Similar configurations are presented. FIGS. 4J and 4L illustrate openings 21 for internal passage between chambers. FIG. 4L includes a mounting ring 23 for attachment of dynamic and static tubes 14 and 16. FIG. 4K illustrates a window 25.

The panels 20 are of structural plastic material having panel attachment points at spaced intervals about the edges of the panels 20. These attachment points 24 are shown to be holes extending through the panels adjacent the edges of these panels. The detail of one of the panels is shown in cross section in FIG. 9.

Figure 5A:
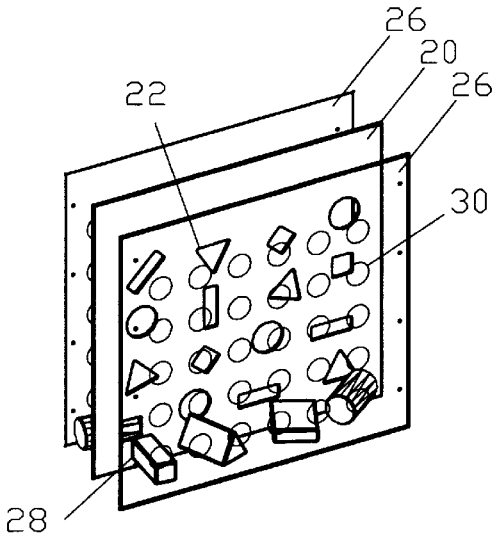
FIG. 5 is a perspective view of manipulative panels for playing games.
Figure 5B:
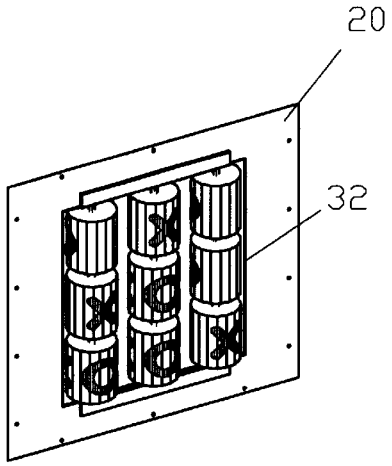

Specialty structures may also be incorporated into the overall play structure. For example, FIG. 5 illustrates two game panels. FIG. 5A illustrates access panels 26 to either side of a panel 20 having holes 22 therethrough which are of various shapes to match puzzle pieces 28. The access panels 26 include access holes 30 through which a child can extend his or her arm to manipulate puzzle pieces 28 through the solid panel 20. By having the access panel holes 30 smaller than the puzzle pieces 28 and sides on the panels 26, retention of the pieces 28 are assured. FIG. 5B illustrates a tic-tac-toe game with rotatably mounted cylinders with "X", "O" and blank spaces on each cylinder 32. These cylinders may alternatively include a number of other symbols, letters or numbers for alternate play.

Figure 6:
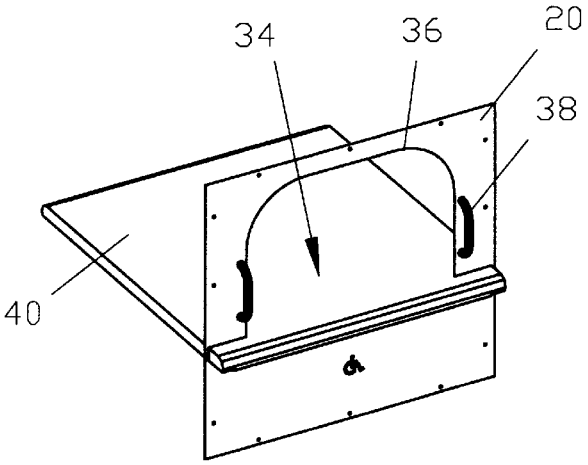
FIG. 6 is a perspective view of a handicap entry panel with a special platform.

FIG. 6 illustrates a handicap entry, generally designated 34. The handicap entry 34 includes a raised door 36 having handles 38 to either side thereof. A platform 40 is also raised to provide a floor at the door 36.

Figure 7:
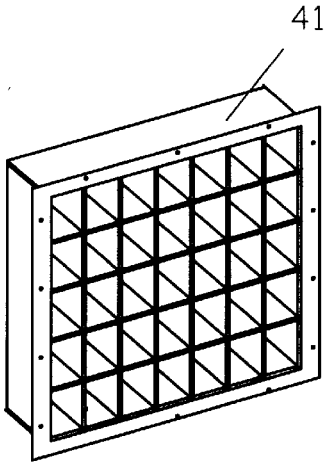
FIG. 7 is a perspective view of a shoe holder.

FIG. 7 illustrates a shoe holder 41 which replaces an outside panel 20 and is divided into many holes to receive children's shoes. The holder 41 location may be as shown in FIG. 1.

FIG. 8 illustrates a series of possible tops 18 to be employed with the structure. These tops 18 make it possible to contain children within the structure. FIG. 8A represents a top 18 which is pyramidal in structure, includes a flag 42 and has logos 43 of the commercial establishment at which the structure is to be located. FIG. 8B illustrates a version without such logos. FIG. 8C is a castle top 18 with a castellated rim 45 about a pyramidal top structure. FIG. 8D includes a clear plastic skylight 44. FIG. 8E illustrates a plane top 18 with holes 46 therethrough. FIG. 8F is a pyramidal top 18 with decorative surface treatment providing the appearance of shingles.

Figure 2A:
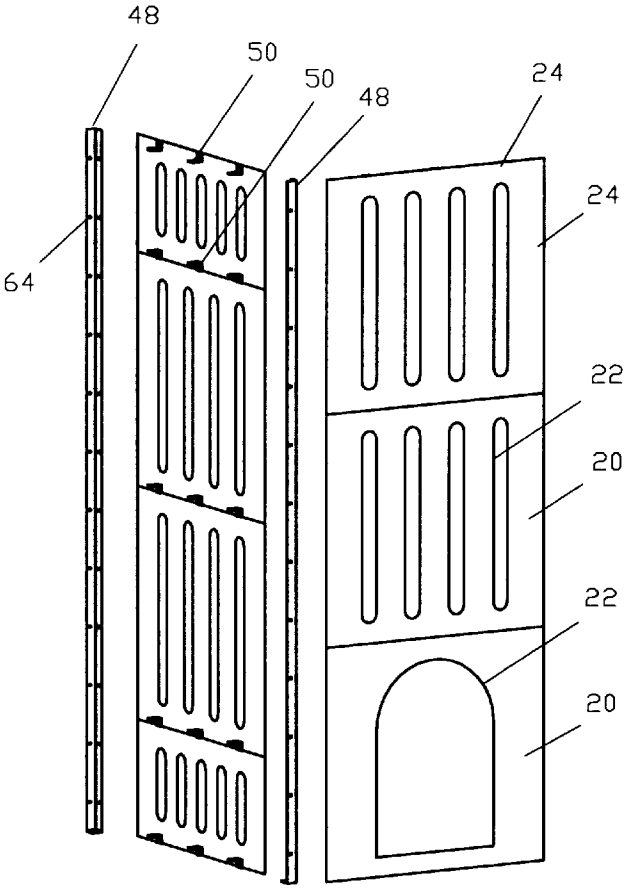
FIG. 2 is a perspective view of one vertical tower illustrated in three states of assembly as FIGS. 2A, 2B and 2C.
Figure 2B:
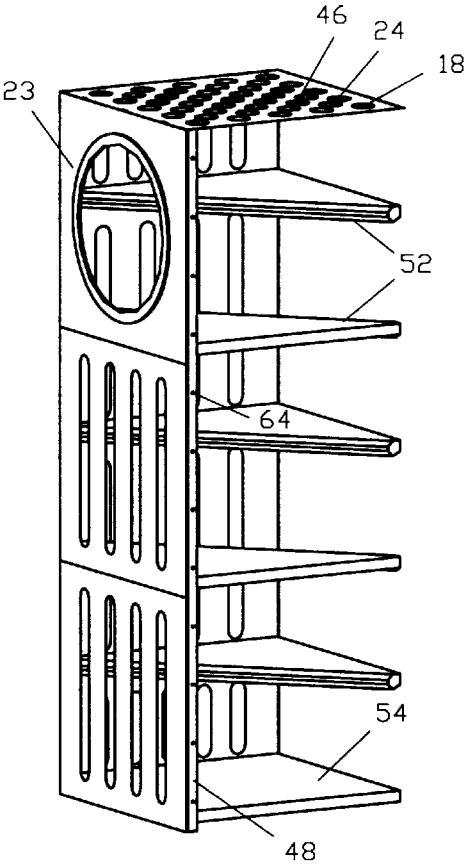
Figure 2C:
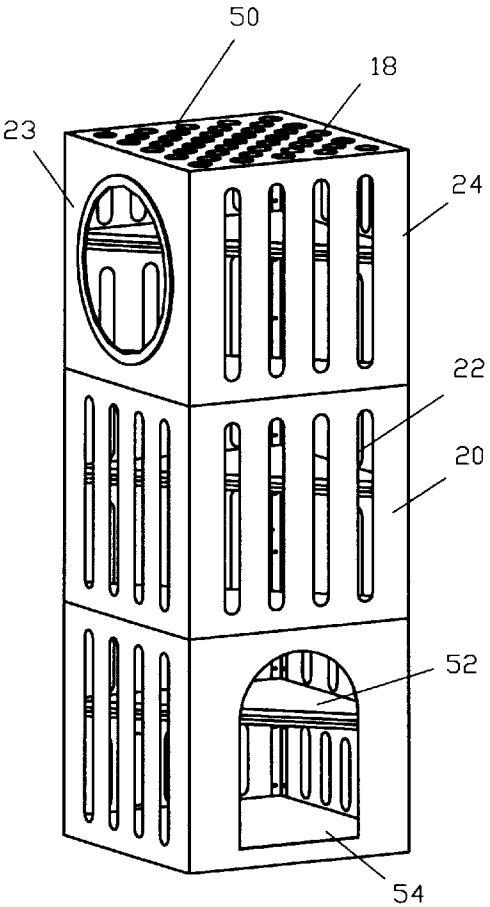
Figure 3A:
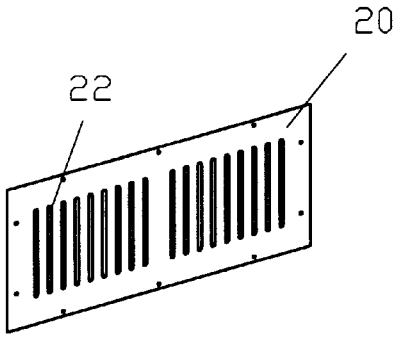
FIG. 3 illustrates in subfigures A through H a typical set of solid, rigid quadrilateral panels of rectangular shape.
Figure 3B:
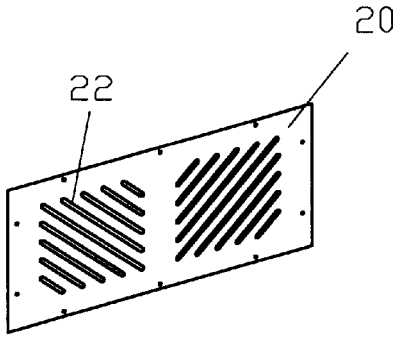
Figure 3C:
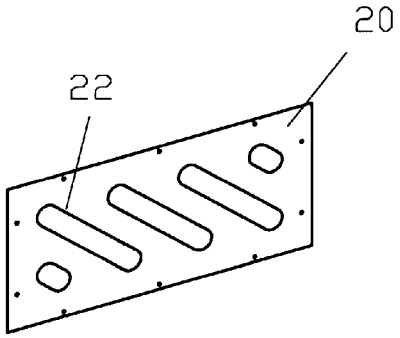
Figure 3D:
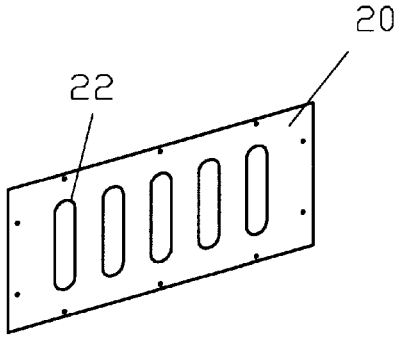
Figure 3E:
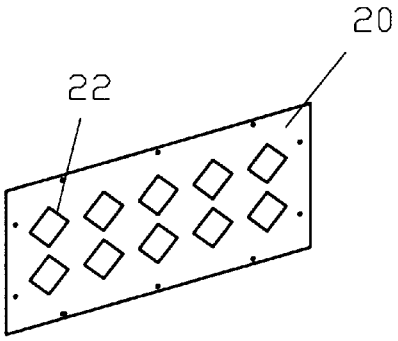
Figure 3F:
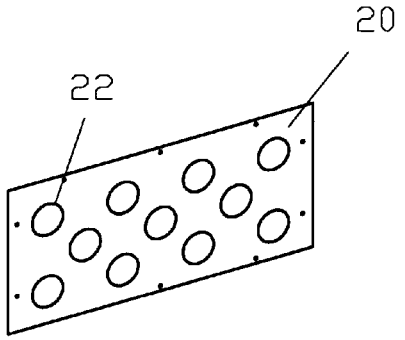
Figure 3G:
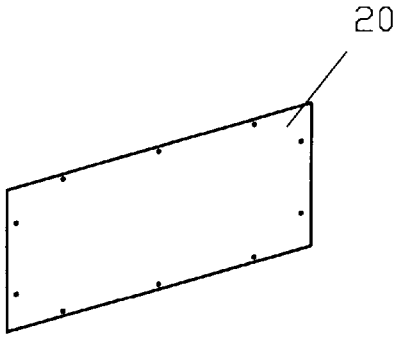
Figure 3H:
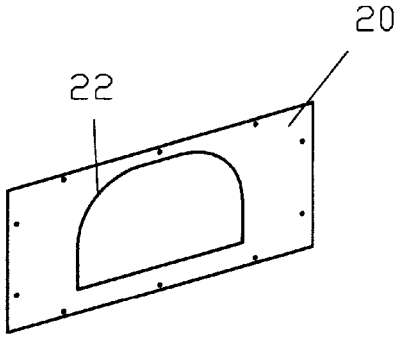
Figure 4A:
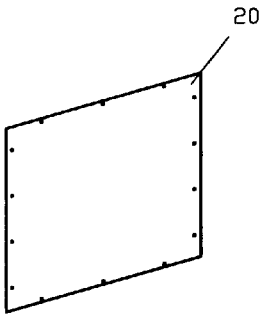
FIG. 4 illustrates in subfigures A through L a typical set of solid, rigid quadrilateral panels of square shape.
Figure 4B:
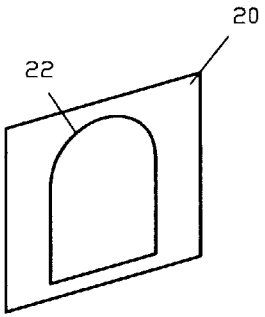
Figure 4C:
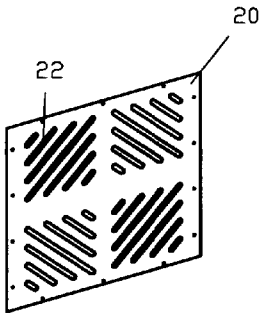
Figure 4D:
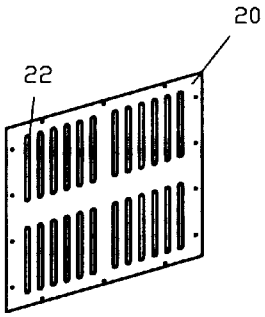
Figure 4E:
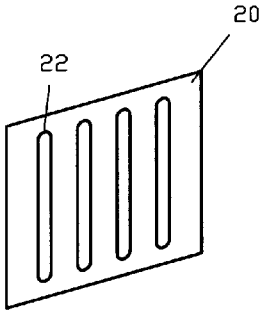
Figure 4F:
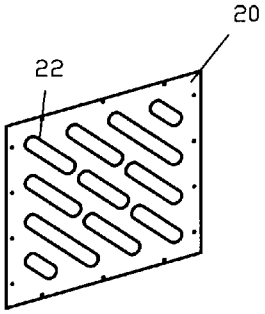
Figure 4G:
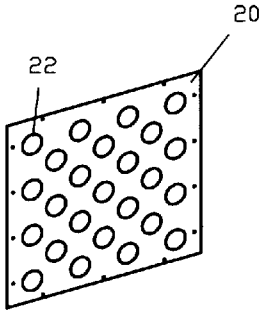
Figure 4H:
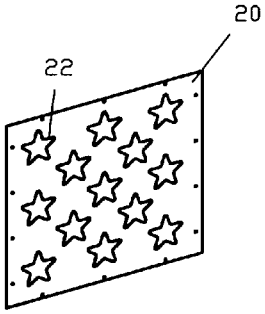
Figure 4I:
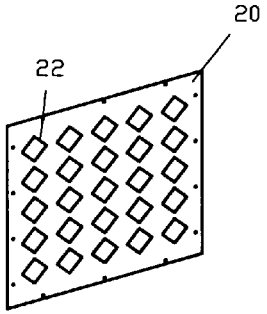
Figure 4J:
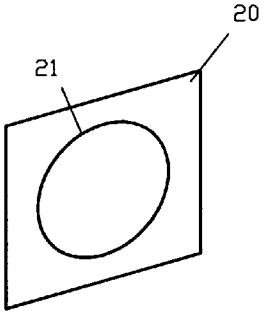
Figure 4K:
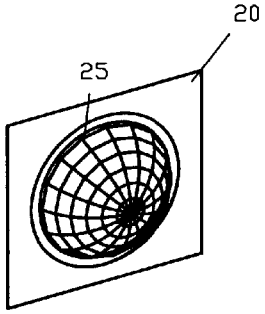
Figure 4L:
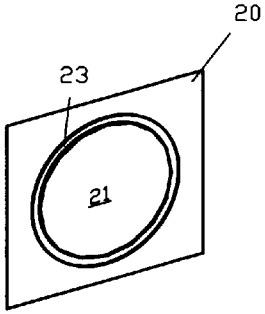
Figure 8A:
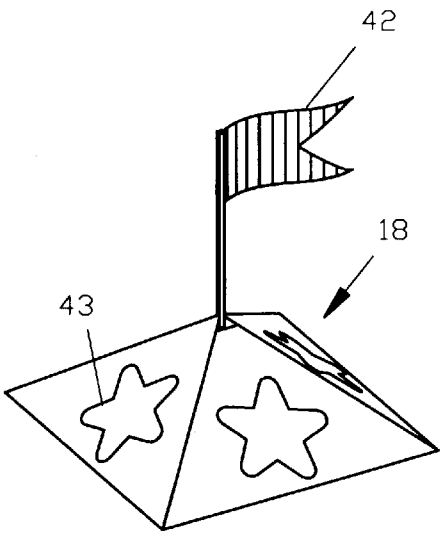
FIG. 8 is a perspective view of a set of top elements.
Figure 8B:
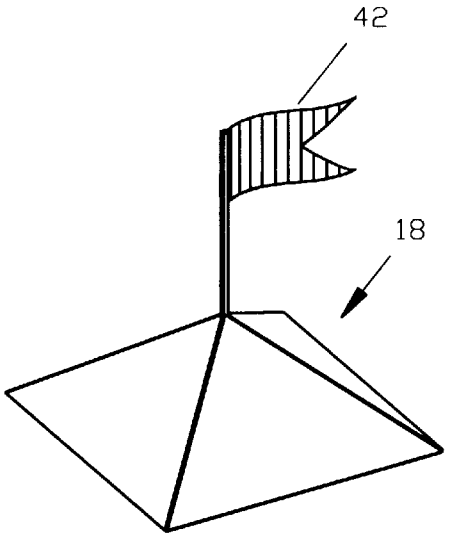
Figure 8C:
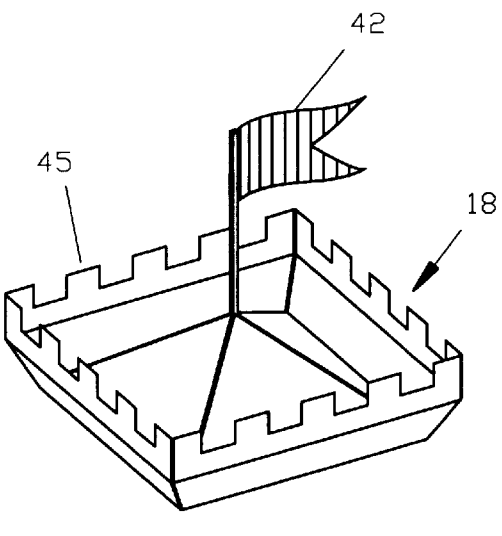
Figure 8D:
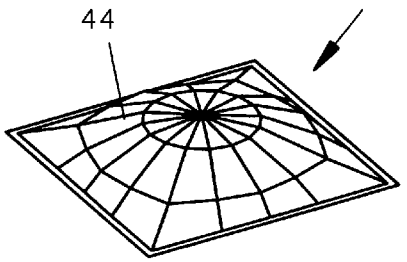
Figure 8E:
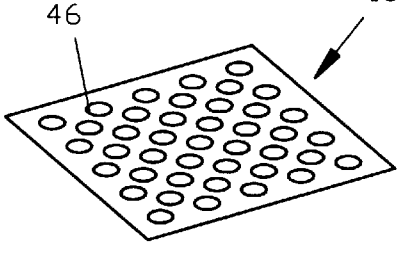
Figure 8F:
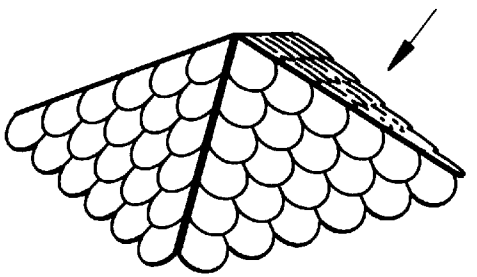

Turning to the construction of the structure, FIGS. 2, 9, 10, 12 and 14 are instructive. FIG. 2 illustrates progressive assembly of a tower. FIG. 2A shows various panels 20 arranged in two planes. Two rigid, elongate angle brackets 48 are illustrated in this construction. Platform angle brackets, generally designated 50, are shown on one of the two assembled planes of panels 20. In FIG. 2B, the tower is partially assembled with platforms in place. Certain of the platforms 52 are triangular in plan while the lowermost platform 54 is rectilinear in plan. A top 18, such as illustrated in FIG. 8E, is located as the highest horizontal member in the tower. In FIG. 2C, it can be seen that the platforms 52 which are triangular in plan include a hypotenuse which is displaced from the rigid panels 20. The platform 54 which is rectilinear in plan of course touches all adjacent panels 20.

Figure 9:
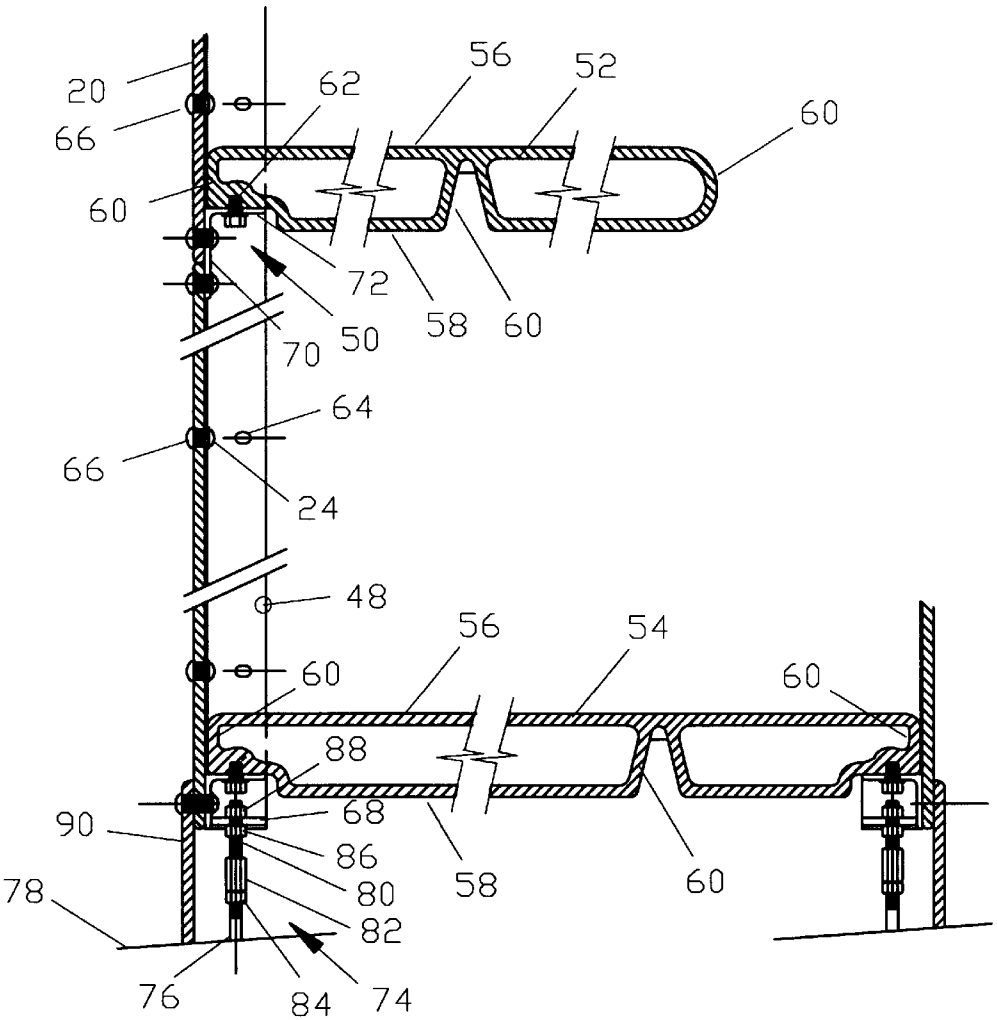
FIG. 9 is a cross-sectional view of rigid platforms associated with solid rigid panels.
Figure 10:
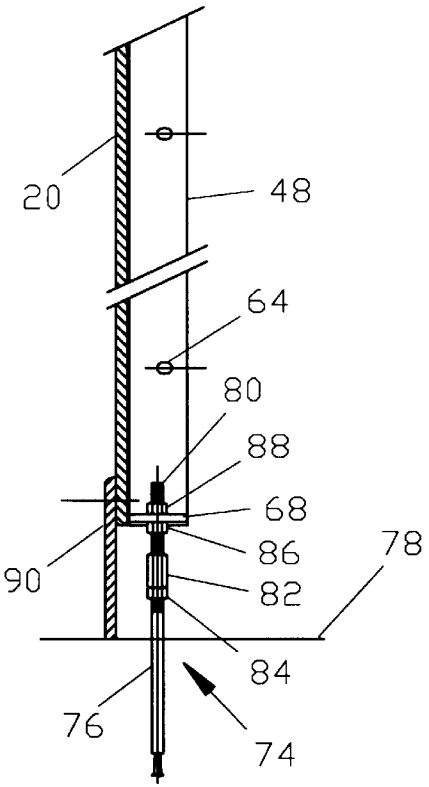
FIG. 10 is a cross-sectional side view of an anchor with an elongate angle bracket and associated side panel.
Figure 11:
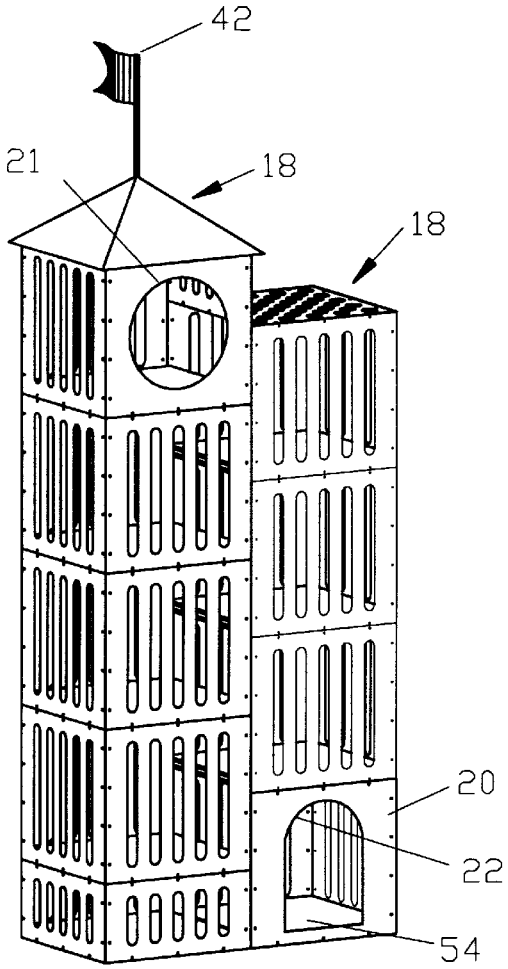
FIG. 11 is a perspective view of a tower with an associated lower connecting wall structure.
Figure 12:
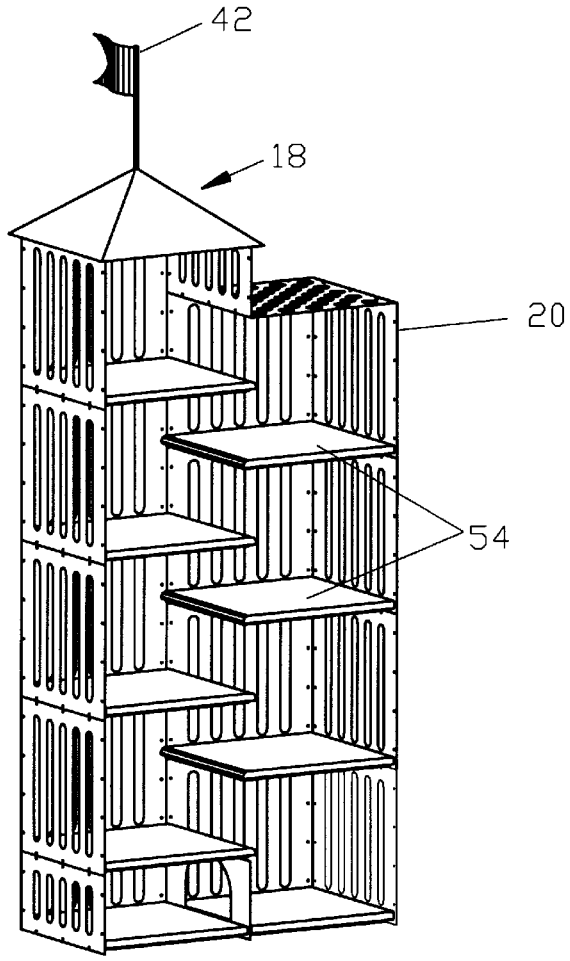
FIG. 12 is a perspective view of the tower and associated lower connecting wall structure of FIG. 11 with the front wall removed.
Figure 14:
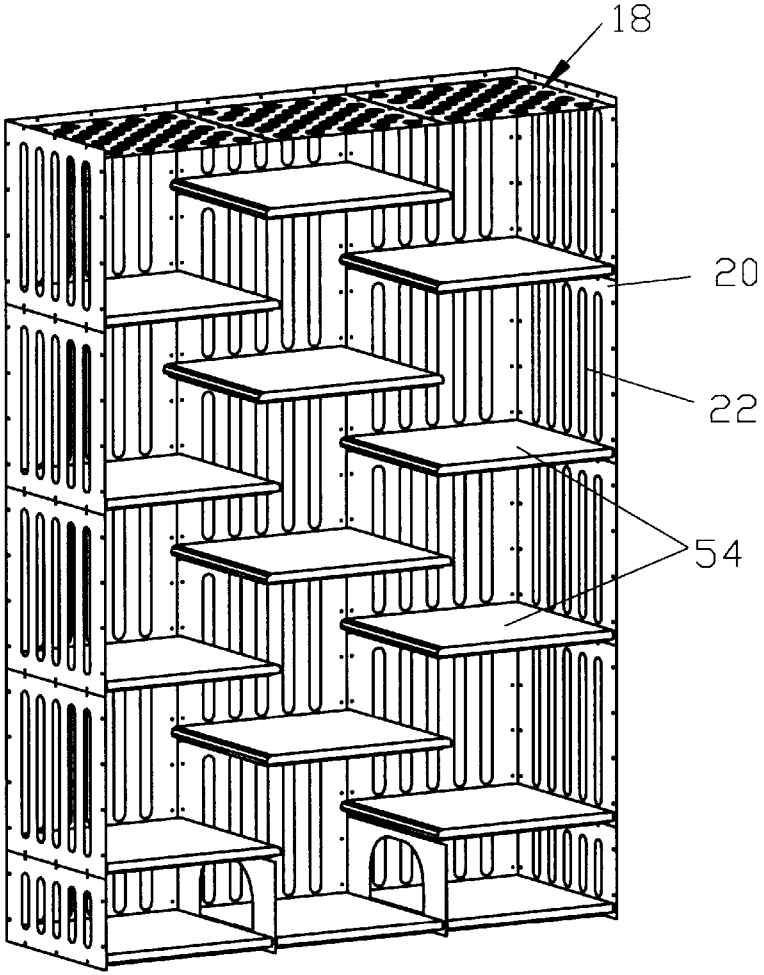
FIG. 14 is a perspective view of the associated lower connecting wall structures of FIG. 13 with the front wall removed.
Figure 13:
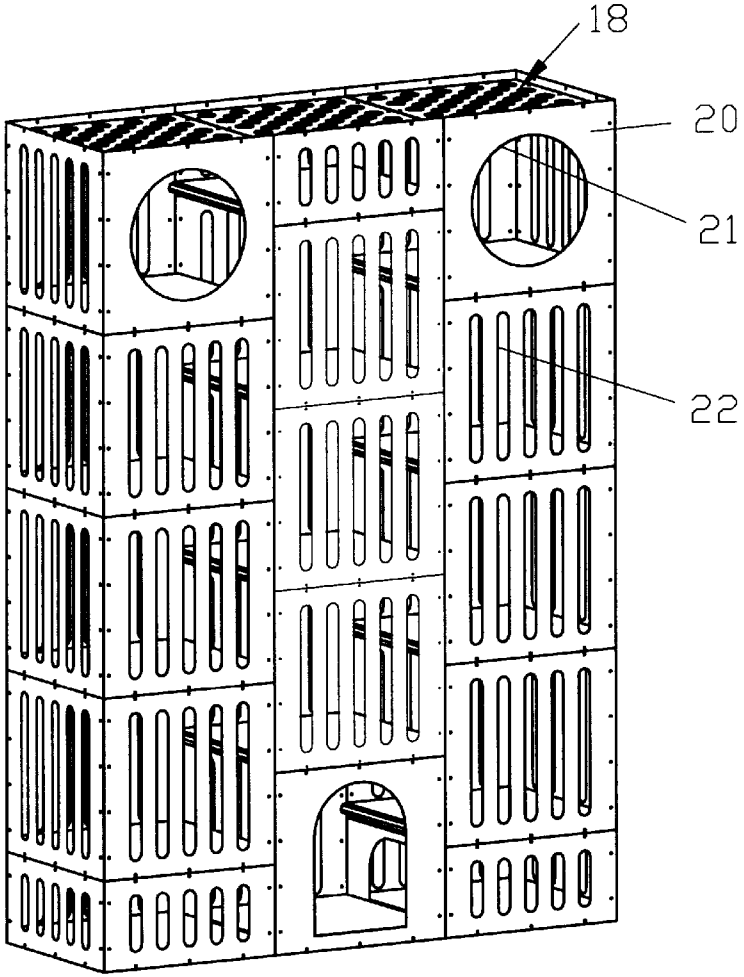
FIG. 13 is a perspective view of associated lower connecting wall structures.

Turning more specifically to FIG. 9, the platforms 52 and 54 are shown to be of double wall thickness with upper walls 56 and lower walls 58 joined at appropriate places by webs 60 at both kiss off support points and about the peripheries thereof to insure resistance to bending. The platforms 52 and 54 include molded in T-nuts 62 to act as attachment points about the periphery of these platforms 52 and 54.

The rigid, elongate angle brackets 48 are shown to extend vertically and include bracket attachment points 64 which are holes. Fasteners 66 extend through the attachment point 64 and attachment points 24 on the panels 20. The brackets 48 are positioned within the included angle between adjacent panels 20. With low level structures, elongate angle brackets 48 are not necessary. Rather, multiple small angle brackets, each associated with one attachment point 64 per panel, may be employed. Where the elongate angle brackets 48 are employed, a plate 68 is welded to one end. The plate 68 includes an anchor hole therethrough to receive anchor supports to mount and level the overall structure.

Platform angle brackets 50 are also illustrated in FIG. 9. The platform angle brackets 50 are shown to include an extended leg 70 capable of cooperating with the attachment points 24 on adjacent panels 20 lying in a common plane. Fasteners 66 associate the platform angle brackets 50 with the abutting panels 20. On the other leg 72 of the platform angle brackets 50, a single attachment point is presented to cooperate with the T-nuts 62 molded into the platforms 52 and 54 to accommodate fasteners 66.

Anchor supports, generally designated 74, cooperate with the anchor plate 68 associated with the elongate angle brackets 48. The anchor supports 74 include anchors 76 embedded in a foundation 78. The anchors 76 include threaded bores to receive threaded rods 80 that may be positioned therein. A coupling nut 82 and a jamb nut 84 retain each rod 80 in the associated anchor 76. At the anchor plate 68, a leveling nut 86 and a lock nut 88 locate each elongate angle bracket 48 in relation to the associated anchor plate 68. The assembly operates to anchor and level the structure. An outer skirt 90 may be attached at convenient panel attachment points by extended fasteners 66 as seen in FIG. 9. The outer skirt 90 is preferably cut to fit.

In the assembly of these structures, panels 20 are typically arranged about all vertical sides defining each chamber. Thus, wall angle brackets, whether they be short or elongate, may be placed to either side of a common panel 20 between two chambers and attached with a common fastener 66. Horizontally adjacent panels 20 lying in a common plane would then be attached to the separate wall angle brackets such that the wall angle brackets are placed within the included angles, respectively, between the common panel 20 and the abutting panels 20.

Climbing areas are also possible as illustrated in FIGS. 11 through 14. Laterally adjacent and coplaner panels 20 are not divided by another panel 20 arranged between and perpendicular to the first panels 20. Flat brackets, elongate or otherwise, may traverse the joint between such laterally adjacent and coplaner panels 20, attaching by fasteners 66 to the laterally adjacent attachment points 24. The platforms 54 span between the resulting front and back walls of multiple panel width and height and are attached by platform brackets as before. The platforms 54 are arranged so that there is no direct vertical path greater in length than one panel high. The holes 21 in these assemblies are intended to lead to other parts of the overall structure.

Thus, an improved play structure is described. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A multi-layer and multi-chamber play structure comprising solid, rigid quadrilateral panels arranged substantially vertically and including panel attachment points along the edges thereof, some of the quadrilateral panels further including holes therethrough displaced inwardly of the edges;

fasteners;

wall brackets attached by the fasteners to adjacent said quadrilateral panels at the attachment points along the vertical edges;

platform angle brackets attached by the fasteners to the quadrilateral panel edges which extend between the vertical edges of the quadrilateral panels, some of the platform angle brackets each being attached by fasteners at the panel attachment points to two vertically adjacent said quadrilateral panels lying in a common plane;

platforms, each platform including a double wall thickness and webs therebetween to increase resistance to bending of the platforms, the platforms being attached to the quadrilateral panels by the platform angle brackets.

2. The play structure of claim 1, at least some of the platforms being triangular in plan and displaced from any of the quadrilateral panels along the hypotenuse thereof.

3. The play structure of claim 2, at least some of the platforms being rectilinear in plan.

4. The play structure of claim 1, the wall brackets being wall angle brackets and in the included angle between adjacent said quadrilateral panels.

5. A multi-layer and multi-chamber play structure comprising solid, rigid quadrilateral panels arranged substantially vertically and including panel attachment points along the edges thereof, some of the quadrilateral panels further including holes therethrough displaced inwardly of the edges;

fasteners;

rigid, elongate angle brackets including bracket attachment points, at least some of the quadrilateral panels being attached along two opposed edges to the rigid, elongate angle brackets, respectively, by the fasteners at the panel attachment points and the bracket attachment points with the rigid, elongate angle brackets being in the included angle between adjacent said quadrilateral panels, the rigid, elongate angle brackets being attached to multiple quadrilateral panels which are vertically adjacent and lying in common planes;

platform angle brackets attached along a third edge of the quadrilateral panels by the fasteners at the panel attachment points;

platforms, each platform including a double wall thickness and webs therebetween to increase the bending moment of the platforms, the platforms being attached to the solid quadrilateral panels by the platform angle brackets.

6. The play structure of claim 5, at least some of the rigid, elongate angle brackets each including a plate fixed in the included angle at one end of the rigid, elongate angle brackets with an anchor hole therethrough.

7. The play structure of claim 6 further comprising a foundation;

anchor supports fixed in the foundation and extending to at least some of the anchor holes for support of the play structure.

8. The play structure of claim 7, the anchor supports including an anchor having a threaded bore and a threaded rod extending into the threaded bore.

9. The play structure of claim 5, the platform angle brackets being attached to two adjacent solid quadrilateral panels lying in a common plane at the panel attachment points.

10. The play structure of claim 5, at least some of the platforms being triangular in plan and displaced from any of the solid quadrilateral panels along the hypotenuse thereof.

11. The play structure of claim 10, at least some of the platforms being rectilinear in plan.

12. A multi-layer and multi-chamber play structure comprising solid, rigid quadrilateral panels arranged substantially vertically and including panel attachment points along the edges thereof, some of the quadrilateral panels further including holes therethrough displaced inwardly of the edges;

fasteners;

rigid, elongate angle brackets including bracket attachment points, at least some of the quadrilateral panels being attached along two opposed edges to the rigid, elongate angle brackets, respectively, by the fasteners at the panel attachment points and the bracket attachment points with the rigid, elongate angle brackets being in the included angle between adjacent quadrilateral panels, the rigid, elongate angle brackets being attached to multiple quadrilateral panels which are vertically adjacent and lying in common planes, at least some of the rigid, elongate angle brackets each including a plate fixed in the included angle at one end of the rigid, elongate angle brackets with an anchor hole therethrough;

platform angle brackets attached along a third edge of the quadrilateral panels by the fasteners at the panel attachment points;

platforms each including a double wall thickness and webs therebetween to increase the bending moment of the platforms, the platforms being attached to the solid quadrilateral panels by the platform angle brackets, at least some of the platforms being triangular in plan and displaced from any of the solid quadrilateral panels along the hypotenuse thereof and at least some of the platforms being rectilinear in plan.

13. The play structure of claim 12 further comprising a foundation;

anchor supports fixed in the foundation and extending to at least some of the anchor holes for support of the play structure.

14. The play structure of claim 12, the anchor supports including an anchor having a threaded bore and a threaded rod extending into the threaded bore.

15. The play structure of claim 12, the platform angle brackets being attached to two adjacent quadrilateral panels lying in a common plane at the panel attachment points.

16. A multi-layer and multi-chamber play structure comprising solid, rigid quadrilateral panels arranged substantially vertically and including panel attachment points along the edges thereof, some of the quadrilateral panels further including holes therethrough displaced inwardly of the edges;

fasteners;

rigid, elongate angle brackets including bracket attachment points, at least some of the quadrilateral panels being attached along two opposed edges to the rigid, elongate angle brackets, respectively, by the fasteners at the panel attachment points and the bracket attachment points with the rigid, elongate angle brackets being in the included angle between adjacent solid quadrilateral panels, the rigid, elongate angle brackets being attached to multiple quadrilateral panels which are vertically adjacent and lying in common planes;

platform angle brackets attached along a third edge of the quadrilateral panels by the fasteners at the panel attachment points, the platform angle brackets being attached to two adjacent quadrilateral panels lying in a common plane at the panel attachment points;

platforms each including a double wall thickness and webs therebetween to increase the resistance to bending of the platforms, the platforms being attached to the quadrilateral panels by the platform angle brackets, at least some of the platforms being triangular in plan and displaced from any of the solid quadrilateral panels along the hypotenuse thereof and at least some of the platforms being rectilinear in plan and attached to the solid quadrilateral panels along the sides thereof.

* * * * *